US006932010B1

(12) United States Patent
Hoyt

(10) Patent No.: US 6,932,010 B1
(45) Date of Patent: Aug. 23, 2005

(54) SAILBOAT WITH OFFSET BOOM

(76) Inventor: John Garrison Hoyt, Newport R&D, One Maritime Dr., Portsmouth, RI (US) 02871

( * ) Notice: Subject to any disclaimer, the term of this patent is extended or adjusted under 35 U.S.C. 154(b) by 0 days.

(21) Appl. No.: 10/818,911

(22) Filed: Apr. 6, 2004

(51) Int. Cl.[7] ..... B63B 15/00
(52) U.S. Cl. ..... 114/39.21; 114/90; 114/97
(58) Field of Search ..... 114/39.11, 39.21, 114/89, 90, 95, 96, 97, 98, 99, 102.1

(56) References Cited

U.S. PATENT DOCUMENTS

| | | | | | |
|---|---|---|---|---|---|
| 28,364 | A | * | 5/1860 | Hall | 114/96 |
| 28,399 | A | * | 5/1860 | Nute | 114/96 |
| 98,242 | A | * | 12/1869 | Furbish | 114/96 |
| 383,594 | A | * | 5/1888 | Rushton | 114/98 |
| 1,856,803 | A | | 5/1932 | Blackman | |
| 3,173,395 | A | | 3/1965 | Laurent | |
| 3,477,402 | A | * | 11/1969 | Compte | 114/89 |
| 4,263,861 | A | * | 4/1981 | Vicard | 114/39.31 |
| 5,778,814 | A | * | 7/1998 | Taylor | 114/97 |

FOREIGN PATENT DOCUMENTS

| | | |
|---|---|---|
| WO | WO 91/18788 | 12/1991 |

* cited by examiner

*Primary Examiner*—Stephen Avila
(74) *Attorney, Agent, or Firm*—Barlow, Josephs & Holmes, Ltd.

(57) ABSTRACT

A sailboat comprising a hull with a mast has a rotatable strut that supports a continuous boom and holds the boom far enough away from the mast to allow clear air flow over the sail on either tack. The support for the boom at the end of the strut is tubular to allow the boom to move. When the after portion is eased out for off wind sailing, the forward portion automatically is projected to windward bringing the center of effort closer to the mast.

6 Claims, 5 Drawing Sheets

27
25
36
12
22
23
28
36
29
16
18
14
20
10

SAILBOAT WITH OFFSET BOOM

BACKGROUND OF THE INVENTION

All modem sailboat rigs position the mast directly ahead of luff of the sail. In this fashion the mast interferes with the airflow at the vital leading edge of the sail. Lateen rigs are an attempt to separate the supporting mast from the mainsail. Today this rig is found in the popular Sunfish. This rig, however, suffers an inherent deficiency since on one tack the sail presses against the mast. This distorts the aerodynamic shape of the sail and penalizes performance.

In the prior art there are attempts freeing up the luff of the sail as in the Laurent U.S. Pat. No. 3,173,395 but his vessel can not tack as the boom remains on one side of the mast. Another illustration of a free luff is seen in U.S. Pat. No. 1,856,803 in which the boom is slidably coupled to a traveler to space it from the mast. There are also examples of rigs with free luffs as in PCT publication WO 91/18788 dated 12 Dec. 1991 that is aimed at a rig with "lifting" benefits for multihulls by angling the sail away from the vertical that creates a lift component.

The instant invention has no lateen spar or slidable or rotating boom as the boom and sail are to leeward of the mast on one tack and to windward of the mast on the other tack. In other words the boom and sail are always on one side of the mast.

SUMMARY OF THE INVENTION

A sailboat having a single sail achieves a balance feature. Physically the sailboat has a mast and an offset boom. A sail is attached at its lower edge to the boom and its upper end to the mast. The offset boom is achieved by providing a strut that rotates about the mast. The strut has a sleeve at its outer end through which the boom extends. The strut holds the boom a sufficient distance away from the mast so that the sail shape is not distorted by the mast. In its final form the upper end of the sail is connected to a rotating strut that may slide aloft with the sail. For furling light line loops are provided at the batten pockets. In a single sail this rig may achieve a semi-balance feature whereby the sail does not create a "turning moment" on the sailboat hull. The rig provides a clean leading edge of the sail and has the ability to reduce sail area without altering the center of effort of the sail. Jibing downwind is also made simple. Should additional sail be required downwind, a hollow boom is used, into which a retracting spar may be fitted, so that a base is provided for the additional sail.

DESCRIPTION OF THE PREFERRED EMBODIMENT

Figure 1:
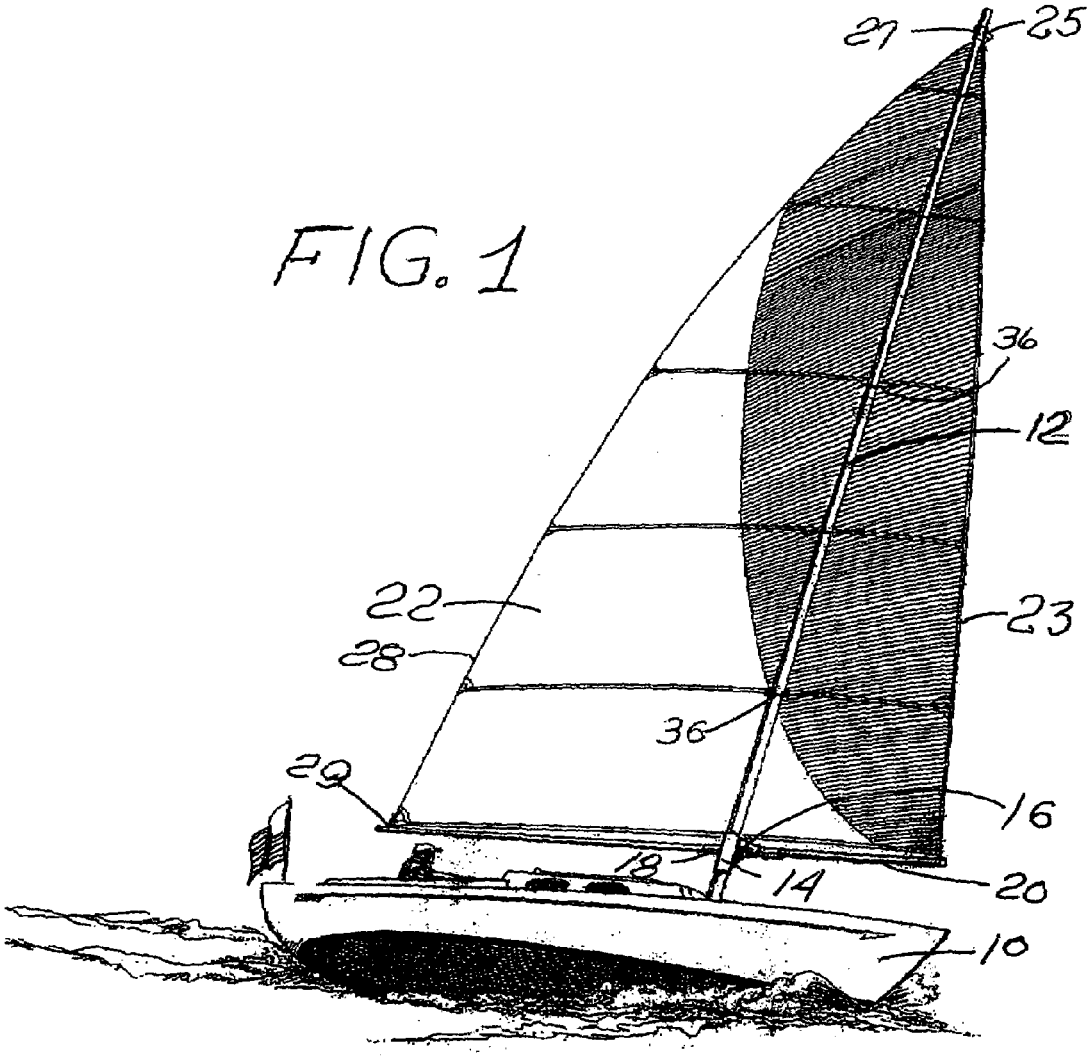
FIG. 1 is a perspective illustration of the invention with a transparent sail.
Figure 5:
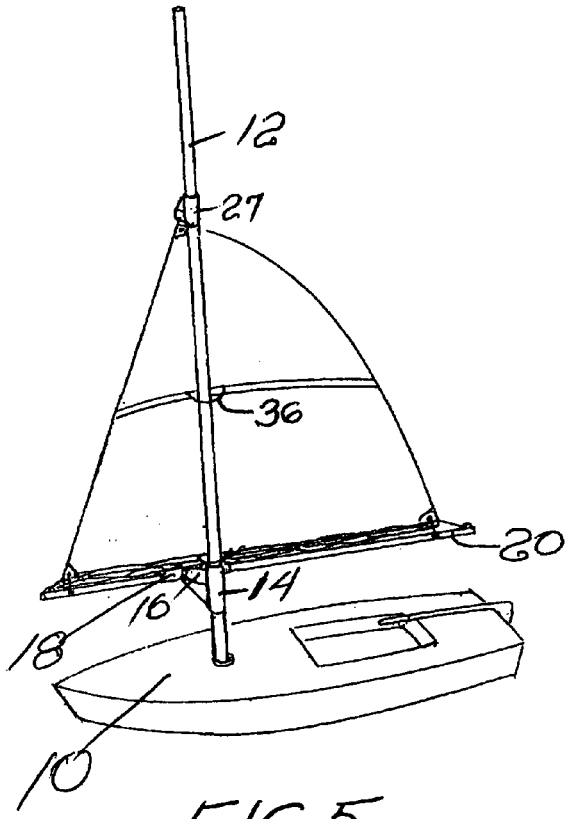
FIG. 5 is an illustration of the sailboat reefed.
Figure 7A:
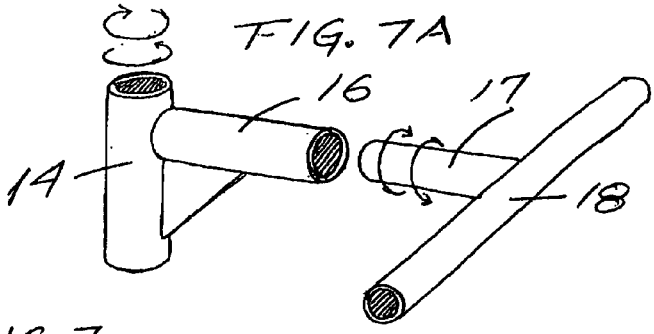
FIG. 7A is a detached perspective view of strut and boom connection.
Figure 7:
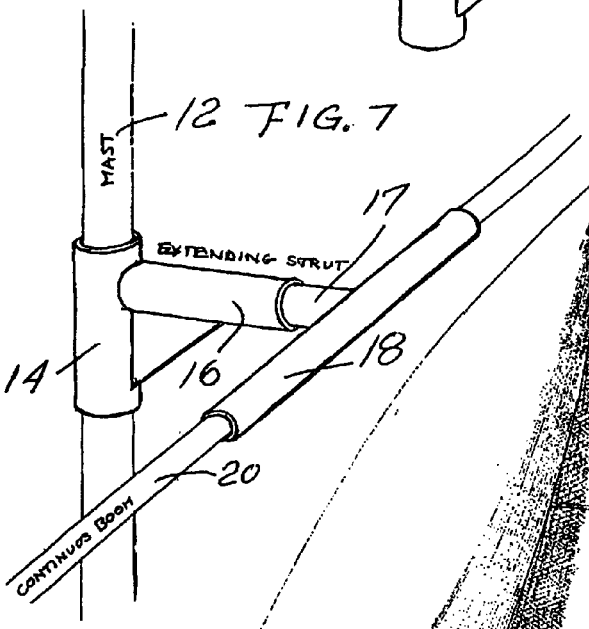
FIG. 7 is a detailed perspective view of the strut and boom of the invention.

Referring to FIG. 1, the basic rig is shown. The sailboat hull 10 is provided with an unstayed tubular mast 12 about which is received a sleeve 14, strut 16 and boom sleeve 18. A connecting tube 17 affixed to the sleeve 18 is preferably used to allow the boom, which is slidably received in the sleeve 18, to assume a proper attitude as illustrated in FIGS. 7 and 7A. A sail 22 has a luff edge 23 fastened to the outer end of the boom 20 and it head or upper end fastened to a small spar 25 that, like the strut 16 is attached to a tubular member 27. The leech edge 28 of the sail is fastened to the boom as at 29. To reef the sail, reef lines 30,30' pass from the boom and trough cringles 34 in the sail (See FIG. 5). Loops 36 that may be of light line pass from batten pockets loosely around the mast to allow a flaked furl. To maintain the boom in various horizontal angles, vangs 32, 32' are provided. The vangs may be adjusted to control luff tension and maximize sail efficiency.

The preferred form for the boom and boom sleeve 18 is tubular. The boom may therefore be slid through the sleeve 18 to provide balancing by moving the center of effort of the sail. Further with a hollow boom, a forward extension 40 to may be added to fly an additional sail downwind (see FIG. 8). The rig as described has the advantage of allowing much simpler tubular construction, which will result in significant cost reduction.

Figure 2:
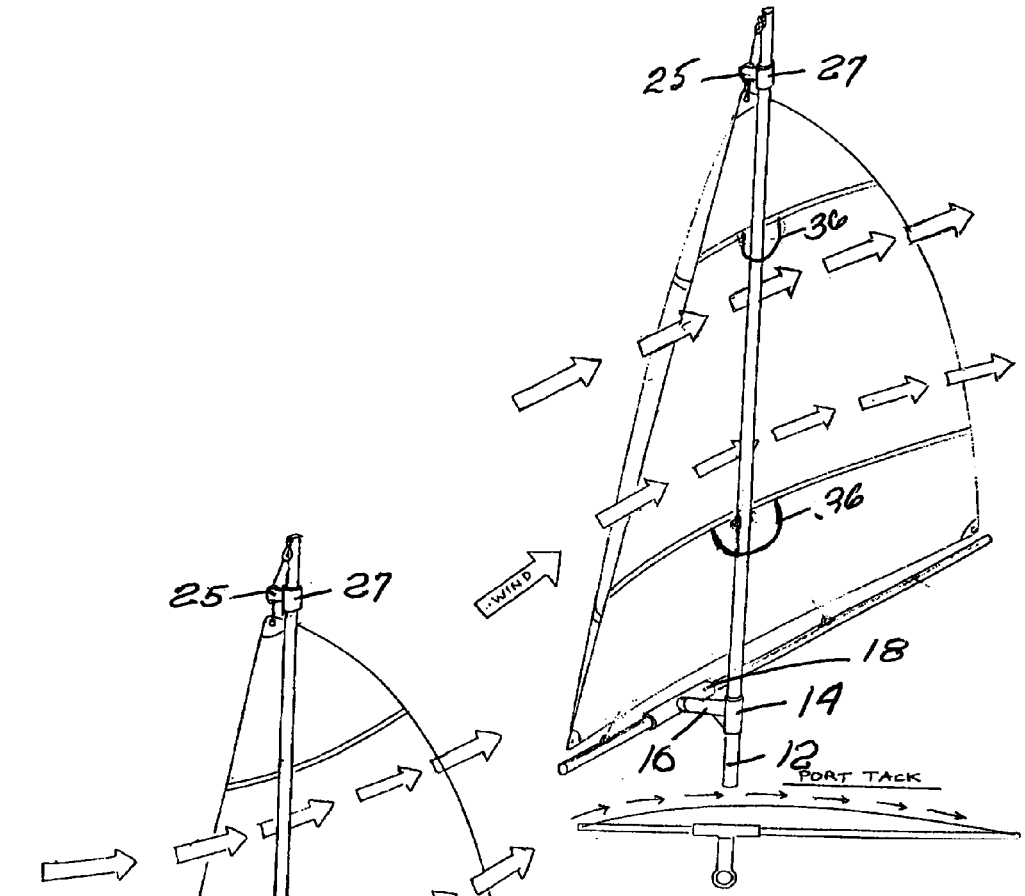
FIG. 2 is a diagrammatic view of the rig with the sail on the port tack.
Figure 3:
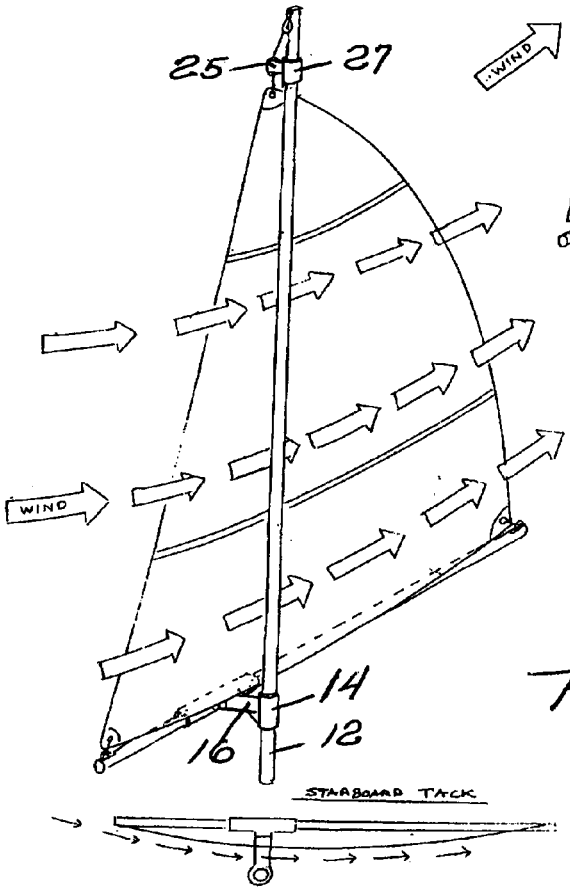
FIG. 3 is a diagrammatic view of the rig with the sail on the starboard tack.
Figure 4:
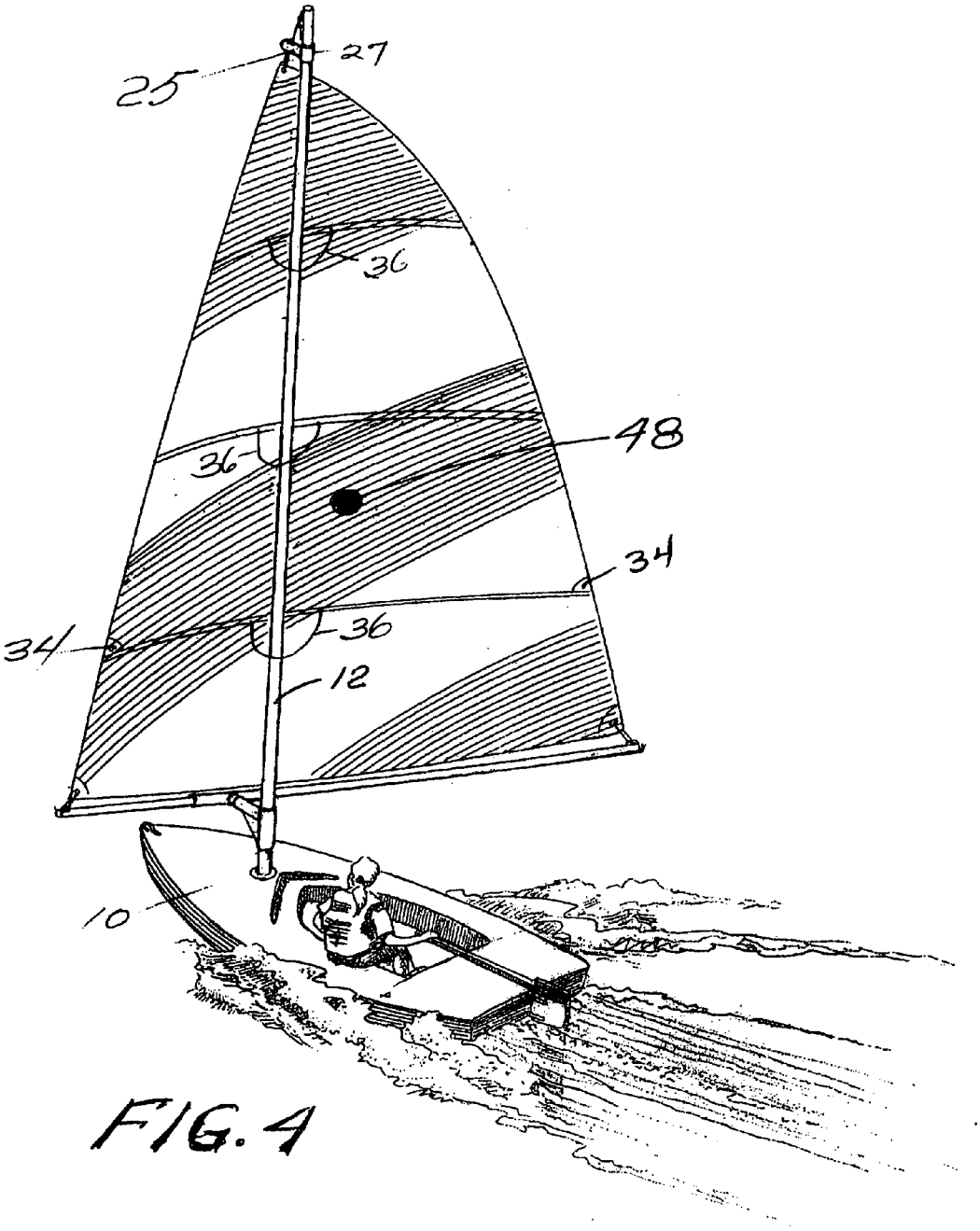
FIG. 4 is a perspective view of the sailboat off the wind.
Figure 6:
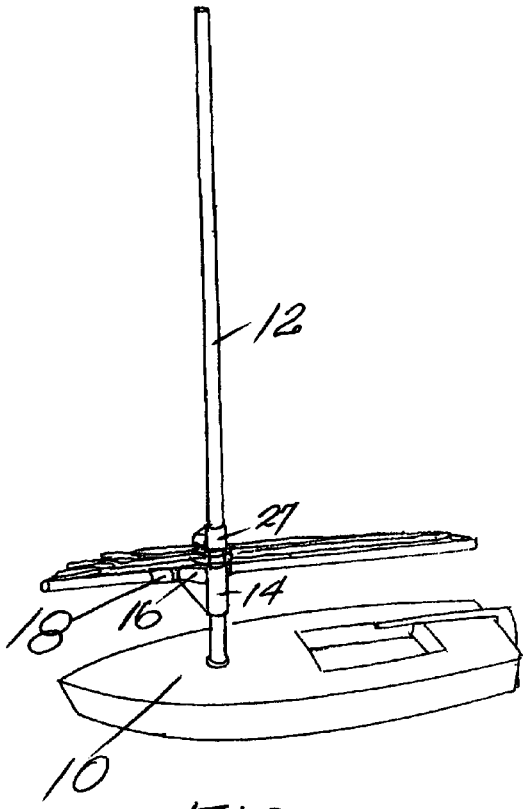
FIG. 6 is an illustration of the sailboat with the sail furled.
Figure 8:
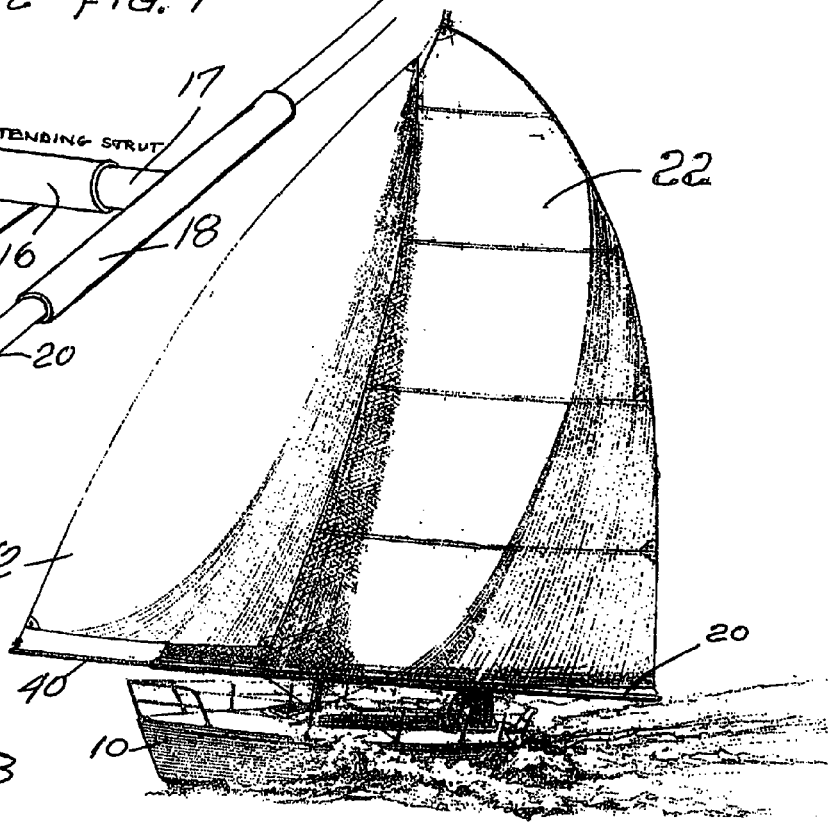
FIG. 8 is a perspective view of the sailboat with a boom extension.

Essentially the strut 16 holds the boom far enough away from the mast so that the mast does not distort the sail or impede the airflow on either tack. This is illustrated in FIGS. 2 and 3 of the drawing. Note particularly FIG. 3 showing the sail on the starboard tack. The sail approaches but does not touch the mast. To illustrate this further, the strut is longer than the roach of the sail, i.e. the curve of the sail. Note in FIGS. 2 and 3 that there is clean airflow on both tacks that is particularly brought about by the diagrams of FIGS. 2 and 3. The boom extends forward and aft of the mast which creates a semi-balanced rig. This results in reduced trimming or tension on the sheet that controls the position of the boom. Downwind performance is particularly benefited as there is less weather helm. Note that he center of effort 48 of the sail, (see FIG. 4) is fairly close to the centerline and still projects a large area of the sail to windward. With reference to FIG. 8, if an extension 40 on the boom is used and another small sail 42 set on that extension, virtual balance can almost be achieved. Off the wind, that is on a reach, on a normal sailboat there is a natural tendency of the end of the boom to rise or "hike up". With this invention this tendency is restrained by the luff tension of the leading edge of the sail. This eliminates the need for a boom vang or preventer.

In sailing this vessel there are some significant advantages that will be observed, for example the sheeting loads are reduced and as the sheet is eased for downwind sailing the sail area projected to windward balances the boat and significantly reduces weather helm and rolling. Even when jibing, the forward part of the sail acts as a brake and slows the swing of the boom across the deck.

What is claimed is:

1. A sailboat having a bow and stern, a mast rising vertically between the bow and stern, a boom, a sail attached at its lower edge to said boom and attached at its upper end of the luff edge to a small spar adapted to rotate about the mast and space the luff from the mast, means including a strut that is rotatably connected to the mast, means at the outer end of the strut to receive the boom thereby spacing the boom from the mast a distance greater than the camber of the sail, the luff edge of the sail being attached to the boom forward of the mast, whereby there is free air flow across the sail.

2. A sailboat as in claim 1 wherein the boom is hollow and a telescoping spar is received in the boom.

3. A sailboat having a mast, a sail, a strut rotatably attached to the mast, a small spar rotatably connecting the upper end of the sail to the upper end of the mast, a boom, said sail affixed to the boom, said strut supporting a full length continuous boom that extends forward of the mast by approximately 25% of the boom length, said sail affixed at its lower edge to the boom, said strut rotating freely about the mast and holding the continuous boom a distance away from the mast greater than the camber of the sail to allow clear air flow over the sail on either tack.

4. A sailboat as in claim 3 wherein the strut has a tubular member at its terminus and said boom is received by said tubular member that is rotatably connected to the strut whereby the boom may rotate in the vertical plane.

5. A sailboat as in claim 4 wherein said rotatable connection of said spar allows vertical and horizontal movement relative to the mast and the vertical rotation of the boom allows the luff and leech of the sail to stabilize the boom whereby a boom vang becomes unnecessary.

6. A sailboat comprising a hull, a mast extending vertically from the hull, a boom coupled to the mast by a strut for horizontal rotation and extending to fore and aft of the mast, a single sail having a head, tack and clew wherein the head is rotationally and operably coupled to the mast by a spar and the tack and clew are connected to opposite ends of the boom, the length of the strut being longer than the camber of the sail whereby the sail is offset from the mast at all points.

* * * * *